US012781956B2

(12) United States Patent
Sumi

(10) Patent No.: US 12,781,956 B2
(45) Date of Patent: Nov. 3, 2026

(54) GAS BURNER AND BOILER

(71) Applicant: MIURA CO., LTD., Matsuyama (JP)

(72) Inventor: Soji Sumi, Matsuyama (JP)

(73) Assignee: MIURA CO., LTD., Matsuyama Ehime (JP)

( * ) Notice: Subject to any disclaimer, the term of this patent is extended or adjusted under 35 U.S.C. 154(b) by 574 days.

(21) Appl. No.: 18/263,884

(22) PCT Filed: Nov. 5, 2021

(86) PCT No.: PCT/JP2021/040732
§ 371 (c)(1),
(2) Date: Aug. 1, 2023

(87) PCT Pub. No.: WO2022/168381
PCT Pub. Date: Aug. 11, 2022

(65) Prior Publication Data

US 2024/0102648 A1 Mar. 28, 2024

(30) Foreign Application Priority Data

Feb. 3, 2021 (JP) ..... 2021-015591

(51) Int. Cl.
*F23D 14/22* (2006.01)
*F23D 14/58* (2006.01)
(Continued)

(52) U.S. Cl.
CPC ..... *F23D 14/22* (2013.01); *F23D 14/58* (2013.01); *F24H 1/40* (2013.01); *F24H 1/403* (2013.01); *F24H 1/0027* (2013.01)

(58) Field of Classification Search
CPC ..... F23D 14/22; F23D 14/58; F24H 1/40; F24H 1/403; F24H 1/0027
See application file for complete search history.

(56) References Cited

U.S. PATENT DOCUMENTS

2005/0211142 A1 9/2005 Yamamoto et al.

FOREIGN PATENT DOCUMENTS

CN 1188872 A 7/1998
CN 1673620 A 9/2005
(Continued)

OTHER PUBLICATIONS

KR-200448947-Y1 translation (Year: 2026).*
JP_2002364812_A translation (Year: 2026).*
KR-20040056882-A translation (Year: 2026).*

*Primary Examiner* — Michael G Hoang
*Assistant Examiner* — Kurt J Wolford
(74) *Attorney, Agent, or Firm* — MUNCY, GEISSLER, OLDS & LOWE, P.C.

(57) ABSTRACT

A gas burner (1) according to one aspect of the present invention includes a fuel supply pipe (10) extending in a predetermined combustion air jet direction and supplied with fuel gas, an air jet port (40) arranged around the fuel supply pipe (10) and jetting combustion air in the combustion air jet direction, and multiple outflow nozzles (70) extending so as not to protrude outward from the fuel supply pipe (10) beyond the air jet port (40) and so as to form an acute inclination angle with respect to the combustion air jet direction and having tip ends forming fuel outlet ports (71) through which the fuel gas flows out.

9 Claims, 4 Drawing Sheets

(51) Int. Cl.
*F24H 1/00* (2022.01)
*F24H 1/40* (2022.01)

(56) References Cited

FOREIGN PATENT DOCUMENTS

| | | | | | | |
|---|---|---|---|---|---|---|
| JP | H11-173506 | A | | 6/1999 | | |
| JP | H11-325402 | A | | 11/1999 | | |
| JP | 2000-55302 | A | | 2/2000 | | |
| JP | 2002-235907 | A | | 8/2002 | | |
| JP | 2002-364812 | A | | 12/2002 | | |
| JP | 2005-273963 | A | | 10/2005 | | |
| JP | 2010-242982 | A | | 10/2010 | | |
| JP | 2013-178023 | A | | 9/2013 | | |
| KR | 2003-0017601 | A | | 3/2003 | | |
| KR | 20040056882 | A | * | 7/2004 | ..... | F23D 14/58 |
| KR | 200448947 | Y1 | * | 6/2010 | ..... | F23D 14/06 |
| KR | 10-1569455 | B1 | | 11/2015 | | |

* cited by examiner

GAS BURNER AND BOILER

TECHNICAL FIELD

The present invention relates to a gas burner and a boiler.

The present application claims a priority based on Japanese Application No. 2021-15591 filed in Japan on Feb. 3, 2021, the contents of which are incorporated herein by reference.

BACKGROUND ART

For example, for a boiler, a gas burner that mixes fuel gas with combustion air to combust the fuel gas has been broadly used. In some cases, the gas burner has a problem that nitrogen oxide (NOx) is generated due to an increase in a combustion temperature. In order to reduce the nitrogen oxide, a self-recirculation burner has been known, which jets combustion air into a furnace at a high speed to attract exhaust gas in the furnace. The jetted combustion air contacts flame while mixed with the exhaust gas, which has a low oxygen concentration, in the furnace, and therefore, combustion slows down and a flame temperature decreases accordingly. Thus, generation of the nitrogen oxide can be reduced.

As such a self-recirculation burner, a gas burner has been known, which is configured such that a fuel nozzle extending in a combustion air jet direction is arranged in a jet flow of combustion air to jet fuel gas into the flow of combustion air (see, e.g., Patent Literature 1).

PRIOR ART LITERATURE

Patent Literature

Patent Literature 1: JP-A-11-173506

DISCLOSURE OF THE INVENTION

Problems to be Solved by the Invention

However, in some cases, the gas burner as described in Patent Literature 1 cannot sufficiently reduce generation of the nitrogen oxide. For example, in the case of using fuel gas having a high combustion speed, such as hydrogen, there is a probability that the amount of generation of the nitrogen oxide increases. Generation of the nitrogen oxide and an increase in an unburned matter in combustion exhaust gas are in a trade-off relationship, and for this reason, there has been a demand not only for reduction in generation of the nitrogen oxide, but also for reduction in generation of the unburned matter.

Thus, the present invention is intended to provide a gas burner and a boiler capable of reducing generation of nitrogen oxide while reducing an unburned matter remaining in combustion exhaust gas.

Solution to the Problems

A gas burner according to one aspect of the present invention includes a fuel supply pipe extending in a predetermined combustion air jet direction and supplied with fuel gas, an air jet port arranged around the fuel supply pipe and jetting combustion air in the combustion air jet direction, and multiple outflow nozzles extending so as not to protrude outward from the fuel supply pipe beyond the air jet port and so as to form an acute inclination angle with respect to the combustion air jet direction and having tip ends forming fuel outlet ports through which the fuel gas flows out.

In the above-described gas burner, the air jet port and the fuel outlet port may overlap with each other as viewed in the combustion air jet direction.

The above-described gas burner may further include an inner wall pipe arranged inside the fuel supply pipe and limiting the section of a fuel gas flow path to an annular shape. The inner wall pipe may have an expanded diameter portion at which the inner wall pipe is diameter-expanded such that the sectional area of the fuel gas flow path is decreased on the upstream side of the outflow nozzles.

The above-described gas burner may further include an inner wall pipe arranged inside the fuel supply pipe and limiting the section of a fuel gas flow path to an annular shape, and an annular sealing plate sealing a clearance between the fuel supply pipe and the inner wall pipe in the middle of the fuel supply pipe. The outflow nozzles may extend from the sealing plate so as to penetrate the fuel supply pipe, and may not be directly fixed to the fuel supply pipe.

In the above-described gas burner, the diameter of the virtual circumscribed circle of the air jet port is preferably less than twice as great as the outer diameter of the fuel supply pipe.

A boiler according to one aspect of the present invention includes the above-described gas burner and a can body having multiple water pipes arranged so as to surround the gas burner and extending in the combustion air jet direction and defining a flow path in which combustion exhaust gas from the gas burner flows in the axial direction of the multiple water pipes.

In the above-described boiler, the diameter of a virtual circle connecting the center of the air jet port is greater than 0.15 times and less than 0.7 times as great as the diameter of the internal space of the can body.

Effects of the Invention

According to the present invention, the gas burner and the boiler capable of reducing generation of the nitrogen oxide while reducing the unburned matter remaining in the combustion exhaust gas can be provided.

DESCRIPTION OF PREFERRED EMBODIMENTS

Figure 1:
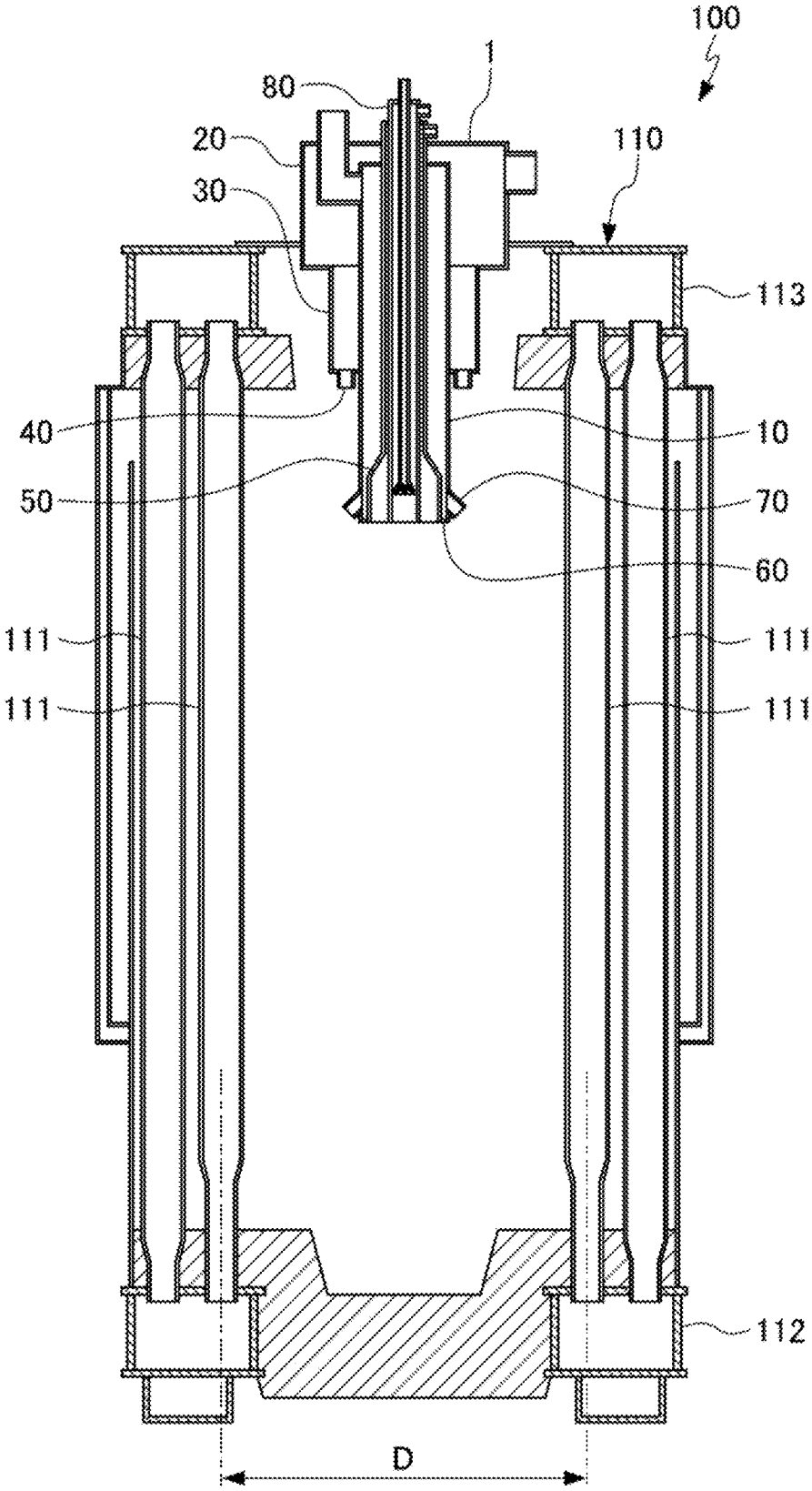
FIG. 1 is a sectional view of a boiler according to a first embodiment of the present invention.
Figure 2:
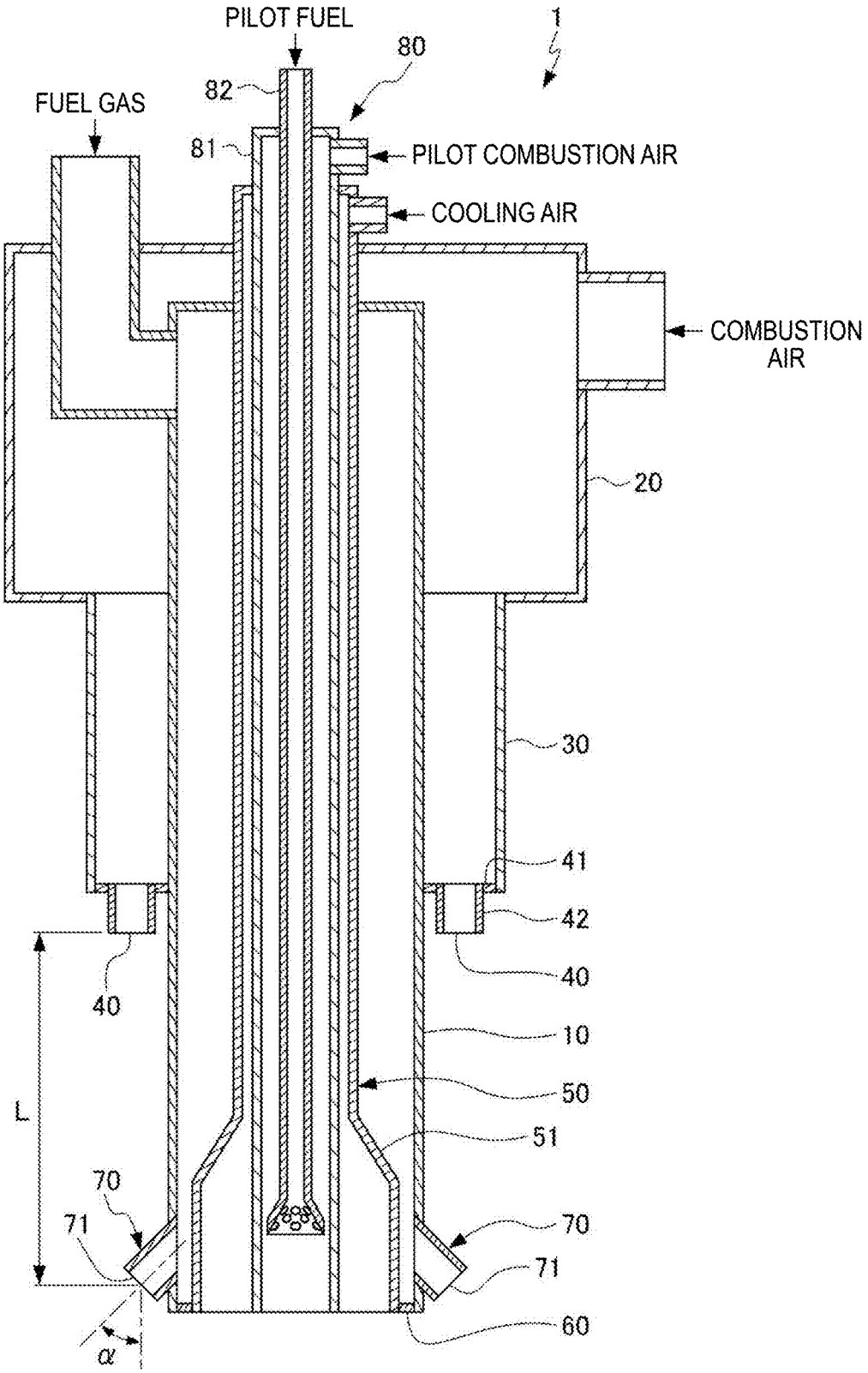
FIG. 2 is a sectional view showing the configuration of a gas burner of the boiler of FIG. 1.
Figure 3:
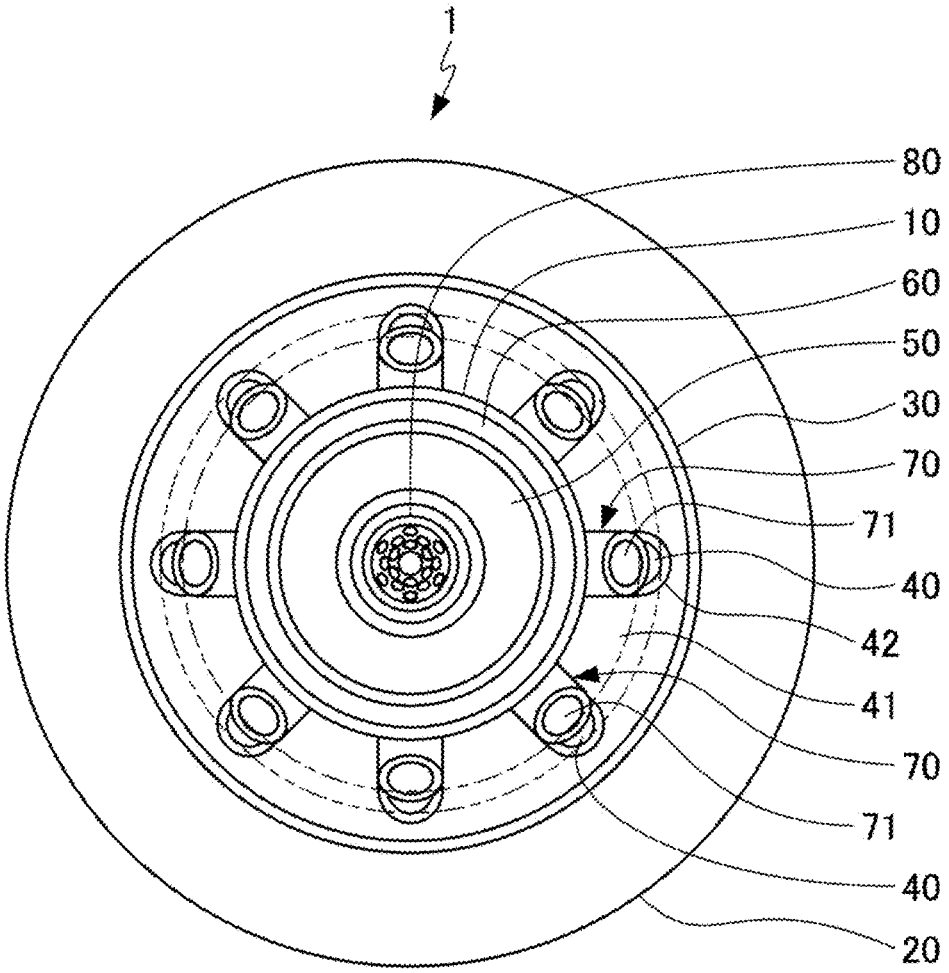
FIG. 3 is a view showing the gas burner of FIG. 2 from a downstream side in a combustion air jet direction.

Hereinafter, embodiments of the present invention will be described with reference to the drawings. FIG. 1 is a sectional view showing the configuration of a boiler 100 including a gas burner 1 according to a first embodiment of the present invention. FIG. 2 is a sectional view showing the configuration of the gas burner 1. FIG. 3 is a view showing the gas burner 1 from a downstream side in a combustion air jet direction.

The boiler 100 includes the gas burner 1 that forms flame extending in the predetermined combustion air jet direction (up-down direction in the present embodiment) and a can body 110 that is heated with combustion exhaust gas from the gas burner 1. The boiler 100 itself is one embodiment of a boiler according to the present invention.

The can body 110 has multiple water pipes 111 arranged so as to surround the gas burner 1 and extending in the combustion air jet direction (up-down direction), a lower header 112 connecting the lower ends of the multiple water pipes 111 to each other, and an upper header 113 connecting the upper ends of the multiple water pipes 111 to each other. The can body 110 defines a flow path in which the combustion exhaust gas from the gas burner 1 flows in the axial direction of the multiple water pipes 111.

In the can body 110, the multiple water pipes 111 are arranged in the form of a double ring as viewed in the jet direction of the gas burner 1. Adjacent ones of the water pipes 111 in the circumferential direction other than end portions of the inner water pipes 111 opposite to the gas burner 1 are connected to each other directly or through a band-shaped member, and are arranged such that no combustion exhaust gas passes therethrough. With this configuration, the combustion exhaust gas from the gas burner 1 passes through a space inside the inner water pipes 111, passes through a clearance between the water pipes 111 at the end portions opposite to the gas burner 1, passes through a space between the inner water pipes 111 and the outer water pipes 111 in the opposite direction, and is discharged to the outside.

The gas burner 1 includes a fuel supply pipe 10 extending in the combustion air jet direction, a window box 20 arranged so as to surround an upstream portion of the fuel supply pipe 10, an air supply pipe 30 arranged outside the fuel supply pipe 10 and extending from the window box 20, multiple air jet ports 40 arranged around the fuel supply pipe 10 and provided at the tip end of the air supply pipe 30, an inner wall pipe 50 arranged inside the fuel supply pipe 10, an annular sealing plate 60 sealing a clearance between the fuel supply pipe 10 and the inner wall pipe 50 at the tip end of the fuel supply pipe 10, multiple outflow nozzles 70 extending from the fuel supply pipe 10 on the downstream side of the air jet ports 40 in the combustion air jet direction, and a pilot burner 80 arranged inside the inner wall pipe 50.

The fuel supply pipe 10 is supplied with fuel gas, and defines a flow path in which the fuel gas is guided to the outflow nozzles 70. For example, as the fuel gas used for the gas burner 1, hydrogen gas, methane gas, propane gas, or gas containing hydrogen is assumed. Specifically, in the case of using hydrogen gas or gas containing hydrogen with a high combustion speed, the present invention produces a prominent effect of reducing nitrogen oxide.

The window box 20 is supplied with combustion air, and introduces the supplied combustion air to the air supply pipe 30 while distributing the combustion air without variation among angular positions with respect to the fuel supply pipe 10.

The air supply pipe 30 guides the combustion air to the air jet ports 40 in the combustion air jet direction along the fuel supply pipe 10.

The air jet port 40 jets the combustion air in the combustion air jet direction (downward in FIGS. 1 and 2). In the shown example, the air jet port 40 is defined by a short pipe 42 arranged at an end plate 41 sealing the tip end of the air supply pipe 30. The multiple air jet ports 40 are formed, across the entire circumference of the fuel supply pipe 10, in an annular shape so as to surround the fuel supply pipe 10, so that the flow of combustion air can be formed along the fuel supply pipe 10.

The air jet ports 40 are preferably provided apart from the fuel supply pipe 10 in the radial direction. Since the air jet ports 40 are provided with a certain distance from the fuel supply pipe 10, the flow of combustion air along the fuel supply pipe 10 can be efficiently formed.

By the jet flow of combustion air from the air jet ports 40, a low-pressure region is formed near the jet flow, and the combustion exhaust gas in a furnace is continuously mixed with the combustion air in the circumferential direction toward a fuel gas supplier along the jet flow. Accordingly, the oxygen concentration of the combustion air is effectively decreased.

The diameter of the virtual circumscribed circle (indicated by a chain double-dashed line in FIG. 3) of the air jet ports 40 is preferably less than twice as great as the outer diameter of the fuel supply pipe 10 and more preferably less than 1.65 times. Since the diameter of the virtual circumscribed circle of the air jet ports 40 is not extremely greater than the outer diameter of the fuel supply pipe 10, the thickness of the jet flow of combustion air is small and the specific surface area thereof per volume is great. Thus, the combustion exhaust gas in the furnace can be efficiently mixed with the jet flow of combustion air.

The diameter of a virtual circle (indicated by a chain line in FIG. 3) connecting the centers of the air jet ports 40 to each other is preferably greater than 0.15 times and less than 0.7 times as great as the diameter D (pitch circle diameter of the inner water pipes 111, see FIG. 1) of the internal space of the can body 110. With this configuration, not only a region where the jet flow of combustion air is mixed with the combustion exhaust gas but also a space necessary for combustion are ensured so that the combustion exhaust gas can be efficiently mixed with the jet flow of combustion air and incomplete combustion can be avoided.

The inner wall pipe 50 is arranged inside the fuel supply pipe 10, and limits the section of the fuel gas flow path to an annular shape. The inner wall pipe 50 has an expanded diameter portion 51 at which the inner wall pipe 50 is diameter-expanded such that the sectional area of the fuel gas flow path is decreased on the upstream side of the outflow nozzles 70. Since the inner wall pipe 50 has the expanded diameter portion 51, the flow velocity of the fuel gas inside a tip end portion of the fuel supply pipe 10 is increased. Thus, the tip end portion, which tends to have a high temperature upon combustion, of the fuel supply pipe 10 can be cooled with the fuel gas, and the durability of the gas burner 1 can be improved. Specifically, the fuel gas has a higher heat conductivity than that of air, and therefore, an increase in an effect of cooling the fuel supply pipe 10 by an increase in the flow velocity of the fuel gas is not so small. Specifically, in the case of using hydrogen gas as the fuel gas, the heat conductivity of the hydrogen gas is 0.257 W/mk at 200° C., which is close to seven times as high as an air heat conductivity of 0.038 W/mk at 200° C. Thus, the effect of cooling the fuel supply pipe 10 by the expanded diameter portion 51 is prominently enhanced.

The sealing plate 60 seals the clearance between the fuel supply pipe 10 and the inner wall pipe 50, which forms the fuel gas flow path. With this configuration, the fuel gas flows out only from the outflow nozzles 70.

The outflow nozzle 70 extends so as not to protrude outward with respect to the air jet port 40 and so as to form an acute inclination angle $\alpha$ with respect to the combustion air jet direction. The outflow nozzle 70 is configured such that the fuel gas flows out from a tip end portion thereof. That is, the tip end of the outflow nozzle 70 forms a fuel outlet port 71 from which the fuel gas flows out.

According to arrangement of the outflow nozzles 70, the position and direction of outflow of the fuel gas can be controlled. Moreover, since the fuel gas flows out from the multiple outflow nozzles 70, deviation in fuel distribution in the circumferential direction of the gas burner 1 can be reduced. Further, the outflow nozzles 70 are provided so that diffusion of the combustion exhaust gas or purge air in the furnace into the fuel supply pipe 10 upon stop of combustion can be reduced.

The outflow nozzles 70 are arranged, on the downstream side of the air jet ports 40, with a certain distance from the air jet ports 40. Since the air jet ports 40 are provided with the certain distance from the fuel supply pipe 10, the jet flow of combustion air is mixed with the combustion exhaust gas in the furnace before mixed with the fuel gas. This decreases the oxygen concentration of the combustion air at the time of mixing with the fuel gas, and therefore, generation of the nitrogen oxide is reduced by a decrease in a combustion temperature.

In the gas burner 1, the fuel outlet ports 71 of the outflow nozzles 70 are arranged in the low-pressure region formed by the air jet flow, and therefore, even in the case of fuel gas having a lower supply pressure than that of a typical case, a necessary amount of fuel gas can flow out. Thus, the gas burner 1 can be used without the need for pressurizing fuel gas having a lower supply pressure, such as by-product hydrogen or low pressure service city gas.

The distance L of the outflow nozzle 70 (center of the fuel outlet port 71) from the air jet port 40 in the combustion air jet direction is preferably three times or more and 15 times or less as long as the equivalent diameter of the air jet port 40 and more preferably six times or more and 12 times or less. Since the distance L of the outflow nozzle 70 from the air jet port 40 is the above-described lower limit or more, the fuel gas can be mixed with the combustion air having such an oxygen concentration that generation of the nitrogen oxide can be effectively reduced. Thus, generation of the nitrogen oxide can be effectively reduced. Moreover, since the distance L of the outflow nozzle 70 from the air jet port 40 is the above-described upper limit or less, incomplete combustion due to an excessive decrease in the oxygen concentration of the combustion air and generation of the nitrogen oxide due to a local temperature increase caused by a decrease in the flow velocity of the combustion air can be reduced.

The outflow nozzle 70 is arranged so as not to protrude from the fuel supply pipe 10 beyond the outermost portion of the outer edge of the air jet port 40 as viewed in the combustion air jet direction. That is, the fuel outlet ports 71 at the tip ends of the outflow nozzles 70 open inside the virtual circumscribed circle of the multiple air jet ports 40 shown in the figure. With this configuration, the fuel gas flows out to the low-pressure region locally formed by the jet flow of combustion air, which is jetted from the air jet ports 40, on the back side of the fuel supply pipe 10, and therefore, the outflow pressure of the fuel gas can be further decreased.

Since the outflow nozzle 70 is inclined, the fuel gas flows out from the fuel outlet port 71 in a state in which the fuel gas has a velocity component in the combustion air jet direction. Thus, the fuel gas quickly moves to the downstream side in the combustion air jet direction, and therefore, a region where the combustion air and the combustion exhaust gas are mixed with each other and the time for such mixing are easily ensured. Consequently, discharge of an unburned matter (uncombusted fuel gas and products of incomplete combustion, such as carbon monoxide) can be reduced. Moreover, since the fuel gas flows out from the outflow nozzle 70 in the direction at the acute angle to the combustion air jet direction, the fuel gas is less likely to contact the water pipes 111 as compared to a case of jetting the fuel gas in the radial direction. Thus, discharge of the unburned matter (uncombusted fuel gas and products of incomplete combustion, such as carbon monoxide) can be more reliably reduced.

The lower limit of the inclination angle $\alpha$ of the outflow nozzle 70 with respect to the combustion air jet direction is preferably 15° and more preferably 30°. On the other hand, the upper limit of the inclination angle $\alpha$ of the outflow nozzle 70 is preferably 75° and more preferably 60°. Since the inclination angle $\alpha$ of the outflow nozzle 70 is the above-described lower limit or more, the opening of the fuel supply pipe 10 is not increased in size in the combustion air jet direction. Thus, attachment of the outflow nozzle 70 can be facilitated, and the strength thereof against thermal stress can be easily ensured. Moreover, since the inclination angle $\alpha$ of the outflow nozzle 70 is the above-described upper limit or less, generation of the nitrogen oxide can be properly reduced.

The air jet port 40 and the fuel outlet port 71 preferably partially overlap with each other as viewed in the combustion air jet direction. Since the air jet port 40 and the fuel outlet port 71 overlap with each other, mixing of the jet flow of combustion air and the fuel gas is promoted. Thus, the unburned matter can be reduced. The degree of overlap is optimized so that both reduction in generation of the nitrogen oxide by a decrease in the oxygen concentration of the combustion air by the influence of the combustion exhaust gas and reduction in the unburned matter by promotion of mixing of the fuel gas with the combustion air can be highly achieved.

The number of outflow nozzles 70 and the angular positions of the outflow nozzles 70 about the fuel supply pipe 10 may be set as necessary regardless of the number of air jet ports 40 and the angular positions thereof.

The pilot burner 80 has a pilot air pipe 81 supplied with pilot combustion air and a pilot fuel pipe 82 arranged inside the pilot air pipe 81 and supplied with pilot fuel. The pilot burner 80 mixes the pilot fuel and the pilot combustion air with each other at a tip end portion of the pilot air pipe 81, thereby forming pilot flame.

Cooling air may be supplied to a clearance between the pilot burner 80 and the inner wall pipe 50. With this configuration, the cooling air can cool, through the inner wall pipe 50, the fuel gas and therefore the fuel supply pipe 10. Thus, the durability of the gas burner 1 can be improved. As the cooling air, part of the combustion air, the flow rate of which is set according to the flow rate of the fuel gas supplied to the fuel supply pipe 10, can be used.

As described above, the gas burner 1 is configured such that the fuel gas is combusted, on the downstream side of the air jet ports 40, with the combustion air having the oxygen concentration decreased by mixing with the combustion exhaust gas in the furnace, so that generation of the nitrogen oxide can be reduced by a decrease in the combustion temperature. Specifically, the gas burner 1 is configured such that the fuel gas flows out from the outflow nozzles 70 in a state in which the fuel gas has the velocity component in the combustion air jet direction, so that the fuel gas can quickly move to the downstream side in the combustion air jet direction. Thus, in the gas burner 1, the region where the combustion air and the combustion exhaust gas are mixed with each other and the time for such mixing are easily ensured, and the remaining unburned matter can be reduced.

Since the gas burner 1 is arranged in the space whose perimeter is closed by the multiple water pipes 111 in the boiler 100, no deviation in the flow of combustion air in the circumferential direction is caused. Thus, the low-pressure region is uniformly formed in the circumferential direction outside the jet flow of combustion air, and the combustion exhaust gas in the furnace is mixed with the combustion air. Consequently, generation of the nitrogen oxide can be reliably reduced while generation of the unburned matter is reduced. For the boiler 100, the can body 110 defining the flow path in which the combustion exhaust gas from the gas burner 1 flows in the axial direction of the multiple water pipes 111 is employed. Thus, not only formation of a portion locally having a high temperature upon combustion can be reduced without deviation in the flow velocity in the axial direction, but also a pressure loss in the can body 110 can be reduced. Consequently, not only an effect of reducing the energy of an air blower is obtained, but also an effect of reducing the supply pressure of the fuel gas is obtained. As a result, the boiler 100 can efficiently generate water vapor while reducing generation of the nitrogen oxide.

Figure 4:
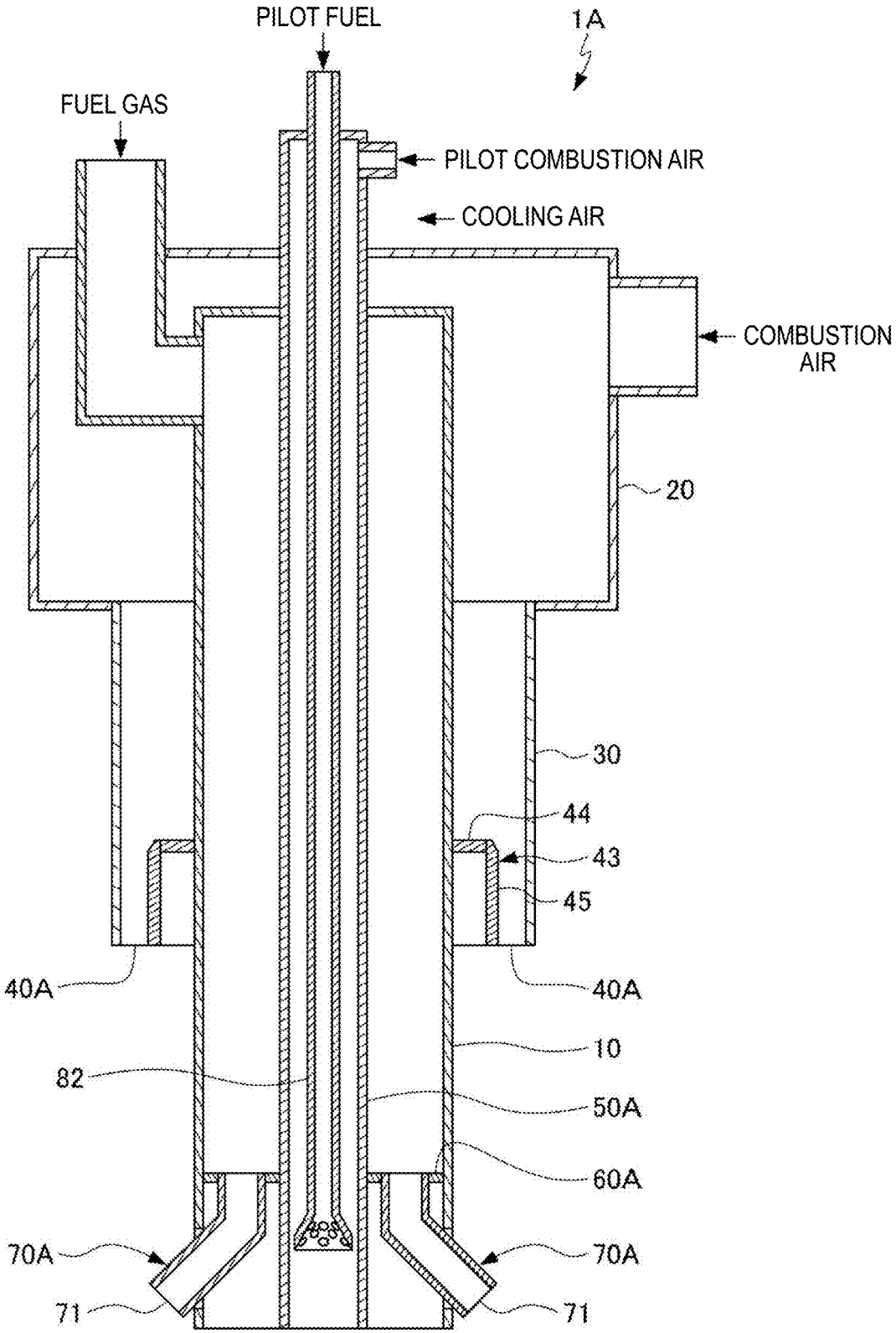
FIG. 4 is a sectional view showing the configuration of a gas burner according to a second embodiment of the present invention.

Subsequently, a gas burner LA according to a second embodiment of the present invention will be described. FIG. 4 is a sectional view showing the configuration of the gas burner LA. Note that in description below, the same reference numerals are used to represent components similar to those of the previously-described embodiment and overlapping description thereof will be omitted as necessary. The gas burner LA can be used in the boiler 100 of FIG. 1 instead of the gas burner 1.

The gas burner LA of the present embodiment includes a fuel supply pipe 10 extending in a predetermined combustion air jet direction, a window box 20 arranged so as to surround an upstream portion of the fuel supply pipe 10, an air supply pipe 30 arranged outside the fuel supply pipe 10 and extending from the window box 20, a single air jet port 40A arranged around the fuel supply pipe 10 and provided at the tip end of the air supply pipe 30, an inner wall pipe 50A arranged inside the fuel supply pipe 10, an annular sealing plate 60A sealing a clearance between the fuel supply pipe 10 and the inner wall pipe 50A at the tip end of the fuel supply pipe 10, multiple outflow nozzles 70A extending from the fuel supply pipe 10 on the downstream side of the air jet port 40A in the combustion air jet direction, and a pilot fuel pipe 82 arranged inside of inner wall pipe 50A.

The air jet port 40A is a clearance between the air supply pipe 30 and a limitation member 43 arranged at the outer periphery of the fuel supply pipe 10 to limit a combustion air flow path. The limitation member 43 may have a circular ring-shaped flange 44 attached to the fuel supply pipe 10 and a guide tubular portion 45 extending parallel with the air supply pipe 30 from the outer edge of the flange 44 to the same position in the combustion air jet direction as that of the tip end of the air supply pipe 30. Thus, the air jet port 40A is an annular opening at the tip end of a clearance between the air supply pipe 30 and the guide tubular portion 45 in the combustion air jet direction.

Preferably, the limitation member 43 is not fixed to the air supply pipe 30, and more specifically, the guide tubular portion 45 and the air supply pipe 30 are not connected to each other through, e.g., a spacer. With such a configuration, in a case where the flow rate of fuel gas and the flow rate of combustion air are increased under a high load, the area of the air jet port 40A is increased by thermal expansion of the air supply pipe 30 due to a temperature increase, and therefore, the pressure loss of the combustion air can be reduced and an increase in energy consumption in an air blower can be restrained.

The inner wall pipe 50A has no expanded diameter portion, and extends with the same diameter to the terminal end. In the gas burner 1A, pilot combustion air is supplied to between the inner wall pipe 50A and a pilot fuel pipe 82. That is, the inner wall pipe 50A in the present embodiment defines a pilot combustion air flow path. Thus, in the gas burner 1A, the fuel supply pipe 10 is indirectly cooled in such a manner that the fuel gas is cooled with the pilot combustion air through the inner wall pipe 50A. Consequently, in the gas burner 1A, the pilot combustion air is preferably supplied even when no pilot flame is formed. In this case, the flow rate of the combustion air jetted from the air jet port 40A may be decreased by an amount corresponding to the flow rate of the pilot combustion air.

The sealing plate 60A seals a clearance, which forms a fuel gas flow path, between the fuel supply pipe 10 and the inner wall pipe 50A on the upstream side with respect to a position at which the outflow nozzles 70A extend from the fuel supply pipe 10 in the middle of the fuel supply pipe 10. The outflow nozzles 70A are connected to the sealing plate 60A, and openings through which the fuel gas flows out to the connected outflow nozzles 70A are formed at the sealing plate 60A.

The outflow nozzles 70A are connected, inside the fuel supply pipe 10, to the sealing plate 60A, extend in the combustion air jet direction from the sealing plate 60A, are bent outward in the radial direction inside the fuel supply pipe 10, and extend so as to penetrate the fuel supply pipe 10. The outflow nozzles 70A penetrate openings formed at the fuel supply pipe 10, and are not directly fixed to the fuel supply pipe 10. That is, the outflow nozzles 70A are fixed to the sealing plate 60A which is not exposed to flame, and are not fixed to a tip end portion of the fuel supply pipe 10 having a high temperature upon exposure to flame. Thus, there is no connection portion, on which thermal stress may be concentrated, between the fuel supply pipe 10 and the outflow nozzles 70A, and therefore, the gas burner 1A has excellent durability.

The preferred embodiments of a heat supply system according to the present invention have been described above, but the present invention is not limited to the above-described embodiments and changes may be made as necessary.

In the case of a configuration in which an outflow nozzle is connected to a sealing plate sealing a clearance between a fuel supply pipe and an inner wall pipe, specifically the case of providing, inside an inner wall pipe, a pilot burner including a pilot air pipe and a pilot fuel pipe, the inner wall pipe may be sealed on the upstream side of the fuel supply pipe.

LIST OF REFERENCE NUMERALS

1, 1A Gas Burner
10 Fuel Supply Pipe
20 Window Box
30 Air Supply Pipe
40, 40A Air Jet Port
41 End Plate
42 Short Pipe
43 Limitation Member
44 Flange
45 Guide Tubular Portion

50, 50A Inner Wall Pipe
51 Expanded Diameter Portion
60, 60A Sealing Plate
70, 70A Outflow Nozzle
71 Fuel Outlet Port
80 Pilot Burner
81 Pilot Air Pipe
82 Pilot Fuel Pipe
100 Boiler
110 Can body
111 Water Pipe

The invention claimed is:

1. A gas burner comprising:

a fuel supply pipe extending in a predetermined combustion air jet direction and supplied with fuel gas;

an air jet port arranged around the fuel supply pipe and jetting combustion air in the combustion air jet direction; and multiple outflow nozzles extending so as not to protrude outward from the fuel supply pipe beyond the air jet port and so as to form an acute inclination angle with respect to the combustion air jet direction and having tip ends forming fuel outlet ports through which the fuel gas flows out, wherein a distance of the outflow nozzle from the air jet port in the combustion air jet direction is three times or more and 15 times or less as long as the equivalent diameter of the air jet port.

2. The gas burner according to claim 1, wherein the air jet port and the fuel outlet port overlap with each other as viewed in the combustion air jet direction.

3. The gas burner according to claim 2, further comprising:

an inner wall pipe arranged inside the fuel supply pipe and limiting a section of a fuel gas flow path to an annular shape, wherein the inner wall pipe has an expanded diameter portion at which the inner wall pipe is diameter-expanded such that a sectional area of the fuel gas flow path is decreased on an upstream side of the outflow nozzles.

4. The gas burner according to claim 3, wherein a diameter of a virtual circumscribed circle having a minimum diameter to include all of the air jet port is less than twice as great as an outer diameter of the fuel supply pipe.

5. The gas burner according to claim 2, further comprising:

an inner wall pipe arranged inside the fuel supply pipe and limiting a section of a fuel gas flow path to an annular shape; and an annular sealing plate sealing a clearance between the fuel supply pipe and the inner wall pipe on the upstream side of the fuel outlet ports, wherein the outflow nozzles extend from the sealing plate so as to penetrate the fuel supply pipe, and are not directly fixed to the fuel supply pipe.

6. The gas burner according to claim 5, wherein a diameter of a virtual circumscribed circle having a minimum diameter to include all of the air jet port is less than twice as great as an outer diameter of the fuel supply pipe.

7. The gas burner according to claim 2, wherein a diameter of a virtual circumscribed circle having a minimum diameter to include all of the air jet port is less than twice as great as an outer diameter of the fuel supply pipe.

8. A boiler comprising:

the gas burner according to claim 2; and a can body having multiple water pipes arranged so as to surround the gas burner and extending in the combustion air jet direction and defining a flow path in which combustion exhaust gas from the gas burner flows in an axial direction of the multiple water pipes.

9. The boiler according to claim 8, wherein the air jet port is provided at each of a plurality of positions at equal distance from a center of the fuel supply pipe, and a diameter of a virtual circle on which each center of the air jet port is located is greater than 0.15 times and less than 0.7 times as great as a diameter of an internal space of the can body.

* * * * *